US005263417A

United States Patent [19]

Godfrey-Phillips

[11] Patent Number: 5,263,417

[45] Date of Patent: Nov. 23, 1993

[54] SHOT GUN CARTRIDGES

[75] Inventor: Arthur H. Godfrey-Phillips, Kent, United Kingdom

[73] Assignee: The Kent Cartridge Manufacturing Company Limited, Kent, United Kingdom

[21] Appl. No.: 852,156

[22] PCT Filed: Oct. 23, 1990

[86] PCT No.: PCT/GB90/01623

§ 371 Date: Apr. 1, 1992

§ 102(e) Date: Apr. 1, 1992

[87] PCT Pub. No.: WO91/05982

PCT Pub. Date: May 2, 1991

[30] Foreign Application Priority Data

Oct. 23, 1989 [GB] United Kingdom ..... 8923797.8

[51] Int. Cl.[5] ..... F42B 7/08

[52] U.S. Cl. ..... 102/453; 102/532

[58] Field of Search ..... 102/448–463, 102/511, 532

[56] References Cited

U.S. PATENT DOCUMENTS

| | | | |
|---|---|---|---|
| 3,363,561 | 1/1968 | Irons . | |
| 3,804,019 | 4/1974 | Hurley . | |
| 3,827,363 | 8/1974 | Curran . | |
| 4,239,006 | 12/1980 | Kelson | 102/511 |
| 5,009,165 | 4/1991 | Morris | 102/513 |

FOREIGN PATENT DOCUMENTS

| | | | |
|---|---|---|---|
| 181473 | 5/1986 | European Pat. Off. . | |
| 2317529 | 10/1974 | Fed. Rep. of Germany . | |
| WO88/09354 | 12/1988 | PCT Int'l Appl. . | |
| 518319 | 2/1940 | United Kingdom . | |
| 2172967 | 10/1986 | United Kingdom | 102/453 |

*Primary Examiner*—Harold J. Tudor
*Attorney, Agent, or Firm*—Nixon & Vanderhye

[57] ABSTRACT

A shot-gun cartridge includes a main wad which is biodegradable. The wad is preferably formed from a composition including synthetic resin natural starch and chemically active prodegradents.

6 Claims, 1 Drawing Sheet

SHOT GUN CARTRIDGES

BACKGROUND

I. Field of the Invention

This invention relates to shot-gun cartridges.

II. Related Art and Other Considerations.

The cartridge illustrated comprises a cylindrical plastics (polyethylene or similar) casing 1 and a brass coated steel-base 2 with retaining rim 3 crimped onto the casing. A percussion actuated primer pad 4 is positioned centrally in the base 2. A base wad 5 being a thick plug of polyethylene or similar is positioned above the primer pad 4. A charge 6 of explosive, typically SANC (small arms nitro compound) is contained in the cartridge above the base wad and a plastics piston-shaped main wad 7, containing the shot pellets 8 is contained in the upper part of the cartridge. The cartridge is completed by a recessed front end closure 9. Thus far described the cartridge is conventional and conventional variations in it may be made.

SUMMARY

The present invention provides a wad for a shot-gun cartridge, the wad having a cup to contain pellets and being molded from a polyolefin-based resin composition. The composition comprises granular starch and is rendered effectively biodegradable by the firing of the cartridge.

DETAILED DESCRIPTION OF THE DRAWINGS

Figure 1:
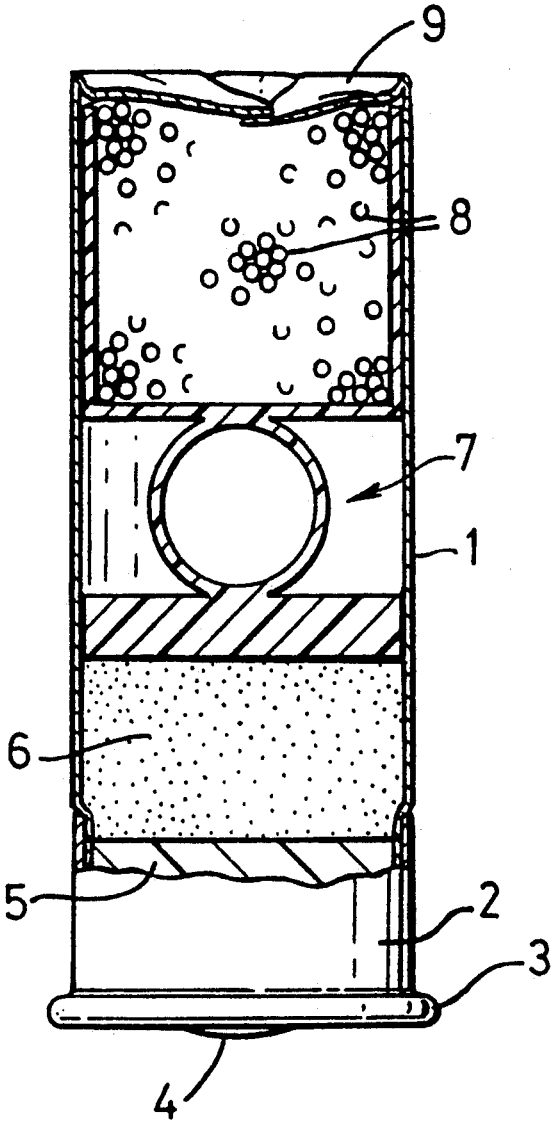
FIG. 1 is a partially sectioned side view of a shot-gun cartridge.
Figure 2:
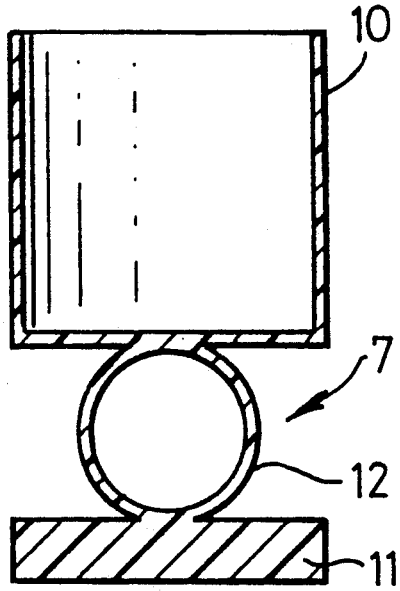
FIG. 2 is a partially sectioned side view of a cartridge wad.

The present invention is concerned with the construction of the main plastics wad 7 shown in FIG. 2, hereinafter referred to as the cartridge wad.

This cartridge wad 7 in the embodiment being described comprises a cylindrical cup 10, the shot cup, which contains the pellets, a piston head or obturator disc 11 to compress the explosive and an 0 or similar shock absorbing cushioning structure 12 intermediate the shot cup 10 and the obturator 11. The cup, cushion and obturator are formed integrally from a synthetic resin (polyethylene or the like) and the cup and obturator fit the cylindrical interior of the cartridge case.

When the gun is fired the cartridge wad emerges from the barrel with the shot and is propelled some considerable distance forward. Unlike the spent cartridge case, which can be collected by the shooter, a fired wad remains in the environment as litter, undesirable and possibly hazardous.

In accordance with the present invention there is provided a piston-type wad for a shot-gun cartridge having a cup to contain pellets and moulded from a polyolefin-based resin composition, said composition comprising granular starch so as to be rendered effectively biodegradable by firing the cartridge.

Degradable plastics are known and this degradation may be initiated by photo; bio- or other mechanisms. Biodegradability as used in this Specification means that the wad is stable for at least its estimated working life. When discharged into a biologically active environment or biosphere and left biodegradation takes place within an environmentally acceptable period of time.

Starch granules are capable of being injection moulded when in admixture with plastics and starch/-plastics formulations perform satisfactorily as cartridge wads. However, to achieve realistically effective biodegradation some other additive, which is initiated in the biosphere, is usually required and to act chemically tend to cause attack on the stable structures of the synthetic resin. Examples of such biodegradable compositions based on synthetic resins and starch are described in U.K. Patent Specification No. 1,485,833 and International Application WO 88/06609. A particularly suitable composition is, however, described in International Application WO 88/09354. This composition comprises a saturated polymer such as polyethylene and a less stable chemically unsaturated polymer or copolymer such as a block copolymer of styrene and butadiene. The composition also includes natural starch or an equivalent vegetable material.

Biodegradable plastics have heretofore been proposed primarily for thin packaging films. In contrast the cartridge wads in accordance with the invention are relatively thick with a wall thickness of up to 3–4 mm.

The compositions from which the wads are made may also advantageously comprise a small amount of a lubricant, for example polytetrafluoroethylene, in order to reduce friction in the wad and to improve consistency and performance.

The invention will be described with reference to the following example:

EXAMPLE I 1 kilogramme of polytetrafluoroethylene micropowder as supplied by the DuPont Corporation, was cold blended with 7.2 kilogrammes of low density polyethylene of MFI 20 AND 1.8 kilogrammes of masterbatch as manufactured by the Archer Daniels Midland Co. of Decatur, Ill. and sold under the Trade Mark POLY-CLEAN. This masterbatch is essentially that blended masterbatch described in Example I of WO 88/09354 and comprises polyethylene, natural maize starch, a block copolymer (synthetic rubber) of styrene and butadiene, and an pro-oxidant cobalt naphthenate. The blended material was used as a feedstock to a twinscrew continuous hot compounding machine. The output, after cooling, was granulated to form a concentrated masterbatch which was then cold-blended with a second commercial masterbatch containing further polyethylene and some green pigment. The final plastics mix contained 8% maize starch, small amounts of polytetrafluoroethylene and green pigment and the balance synthetic resin. This final mix was used as the feedstock to a screw preplasticiser type injection moulding machine which filled a multi-impression injection moulding tool designed to make the shut gun cartridge wads. Samples of the mouldings were assembled with cases, shot, explosive charge, and primer/detonators in the usual manner and then submitted to firing trials whereupon the wads were found to perform excellently.

The wads would have a lifetime of about 2 years when exposed in a temperate environment before disintegrating into harmless fragments which themselves would slowly degrade microbiologically following chemical pathways similar to the degradation in the environment of natural rubber.

With a loading of 8% of natural maize starch in the wads along with sufficient unsaturated elastomer to act as an easily autoxidisable component and a balance of antioxidant and oxidation catalyst to ensure that, at ambient temperature, the product would remain stable for an induction period in excess of the working life after which the product would progressively oxidise with embrittlement and chain breaking of the polyethylene. Soil burial tests of these moulded wads showed that the mechanical properties remained unchanged for about 18 months after which time they progressively weakened and their content of low molecular weight material rapidly increased, this material being susceptible to biological degradation encouraged by the presence of the degrading starch. The stable lifetime could be adjusted as required by varying the ratio between the antioxidant and the oxidation catalyst.

It is believed, moreover, that the firing of the cartridge modifies the plastic wad and renders the fired or spent wad more biodegradable than the unfired.

I claim:

1. A cartridge wad comprising:

a cylindrical cup to fit a gun barrel and containing a charge of shot;

a piston element to slide in the barrel;

a shock absorbing structure disposed between the cup and the piston;

the wad being molded from a composition comprising a polyolefin, biodegradable granular starch and at least one additive, the additive being initiated in the biosphere, which additive acts chemically to attack stable structures of the wad, such composition being stable before being fired and discharged, but being degradable in the biosphere after being fired and discharged.

2. A wad as claimed in claim 1 wherein the composition comprises polyethylene, a chemically unsaturated block copolymer, and a pro-oxidant.

3. A shot-gun cartridge comprising:

a cartridge casing;

a wad positioned in the casing, the wad comprising:

a cylindrical cup to fit a gun barrel and containing a charge of shot;

a piston element to slide in the barrel;

a shock absorbing structure disposed between the cup and the piston;

the wad being molded from a composition comprising a polyolefin, biodegradable granular starch and at least one additive, the additive being initiated in the biosphere, which additive acts chemically to attack stable structures of the wad, such composition being stable before being fired and discharged, but being degradable in the biosphere after being fired and discharged.

4. A cartridge as claimed in claim 3, wherein the composition comprises polyethylene, a chemically unsaturated block copolymer, and a pro-oxidant.

5. A wad as claimed in either claim 1 or claim 8 wherein the said composition includes a lubricant.

6. A wad as claimed in claim 5 wherein the lubricant is polytetrafluoroethylene.

* * * * *